US005388820A

United States Patent [19]

Eberle et al.

[11] Patent Number: 5,388,820

[45] Date of Patent: Feb. 14, 1995

[54] GRIPPER FOR A CONVEYING DEVICE FOR CONVEYING SINGLE-SHEET OR MULTIPLE-SHEET PRINTED PRODUCTS

[75] Inventors: Jurg Eberle, Hinwil; Bruno Weber, Berg, both of Switzerland

[73] Assignee: Ferag AG, Hinwil, Switzerland

[21] Appl. No.: 249,054

[22] Filed: May 25, 1994

Related U.S. Application Data

[63] Continuation of Ser. No. 18,749, Feb. 17, 1993, abandoned.

[30] Foreign Application Priority Data

Feb. 19, 1992 [CH] Switzerland ..... 00495/92

[51] Int. Cl.[6] ..... B65H 5/02

[52] U.S. Cl. ..... 271/277; 271/204; 198/803.9; 198/470.1

[58] Field of Search ..... 271/277, 204, 206, 82; 198/803.9, 470.1; 294/104, 116

[56] References Cited

U.S. PATENT DOCUMENTS

| | | | |
|---|---|---|---|
| 4,307,801 | 12/1981 | Hansch . | |
| 4,381,056 | 4/1983 | Eberle . | |
| 4,746,007 | 5/1988 | Houseman | 198/470.1 |
| 4,852,722 | 8/1989 | Houseman | 198/803.7 |
| 4,905,818 | 3/1990 | Houseman | 198/803.7 |
| 4,953,847 | 9/1990 | Honegger . | |
| 4,968,081 | 11/1990 | Beight et al. | 294/104 |
| 5,064,187 | 11/1991 | Muller | 271/277 |
| 5,188,349 | 2/1993 | Honegger | 271/277 |

FOREIGN PATENT DOCUMENTS

| | | | |
|---|---|---|---|
| 2583067 | 8/1967 | Australia . | |
| 0241631 | 12/1987 | European Pat. Off. | B65H 29/04 |
| 2337210 | 7/1973 | Germany . | |

*Primary Examiner*—H. Grant Skaggs

*Attorney, Agent, or Firm*—Willian Brinks Hofer Gilson & Lione

[57] ABSTRACT

A gripper for use in a conveying device which conveys printed products is disclosed. The gripper has two gripper parts which are mounted so as to be freely pivotable on a shaft. The first gripper part can be pivoted between an open position and a clamping position. This purpose is served by a closing lever which is seated on the shaft so as to be fixed against rotation. The rotary movement of the shaft is transmitted via a resting part, which is connected to said shaft so as to be fixed against rotation, and a compression spring which is supported on the resting part and, at the other end, acts on the first gripper part. The closing lever supports a follower roller which is mounted so as to be freely rotatable and interacts with closing links or cams. A locking device is provided for locking the first gripper part in the clamping position. In order to allow the first gripper part to close in any pivot position of the gripper and with the gripper moving in opposite directions, the closing lever encloses an angle α which is less than 90° with the first gripper part.

16 Claims, 10 Drawing Sheets

GRIPPER FOR A CONVEYING DEVICE FOR CONVEYING SINGLE-SHEET OR MULTIPLE-SHEET PRINTED PRODUCTS

This application is a continuation of application Ser. No. 08/018,749, filed Feb. 17, 1993, now abandoned.

BACKGROUND OF THE INVENTION

The present invention relates to a gripper for a conveying device for conveying single-sheet or multiple-sheet printed products, such as newspapers, magazines and parts thereof. Grippers of this type, are described, for example, in U.S. Pat. No. 4,381,056 and the corresponding DE-A-3,102,242 and U.S. Pat. No. 4,953,847 and the corresponding EP-A-0,330,868.

The gripper of the present invention is lighter and simpler in construction compared to these known grippers. The gripper of the present invention can also be used for the most varied purposes without modifications.

SUMMARY OF THE INVENTION

These objects are achieved by providing a gripper which is to be used in a conveying device which conveys single-sheet or multiple-sheet printed products such as newspapers, magazines and parts thereof which includes first and second gripper parts which are pivotably mounted about a common axis. The first gripper part pivots between an open position and a clamping position in which it interacts with the second gripper part in order to clamp a printed product between the gripper parts under a spring force. The first gripper part is coupled to a closing lever which has a follower member at its end, preferably a rotably mounted roller, the closing lever is intended to interact with fixed closing cams for pivoting the first gripper part into the clamping position. The configuration of the closing lever and of the follower member is such that the first gripper part can be moved into the clamping position by the closing cam acting on the follower member in substantially all pivot positions of the gripper parts and/or with the opening, which is defined between the two gripper parts, pointing in different directions.

A locking device is provided for blocking the first gripper part in its clamping position. The locking device can be released in substantially all pivot positions of the closed gripper by means of fixed opening arrangements such as cams or links.

A positioning follower member, such as a rotatably mounted roller; is coupled to the second gripper part and is intended to interact with fixed positioning cams or links for holding the second gripper part in a particular pivot position.

BRIEF DESCRIPTION OF THE DRAWINGS

Exemplary embodiments of the subject-matter of the invention are explained in detail below with reference to the purely diagrammatical drawings, in which.

DETAILED DESCRIPTION OF THE PRESENTLY PREFERRED EMBODIMENTS

Figure 1:
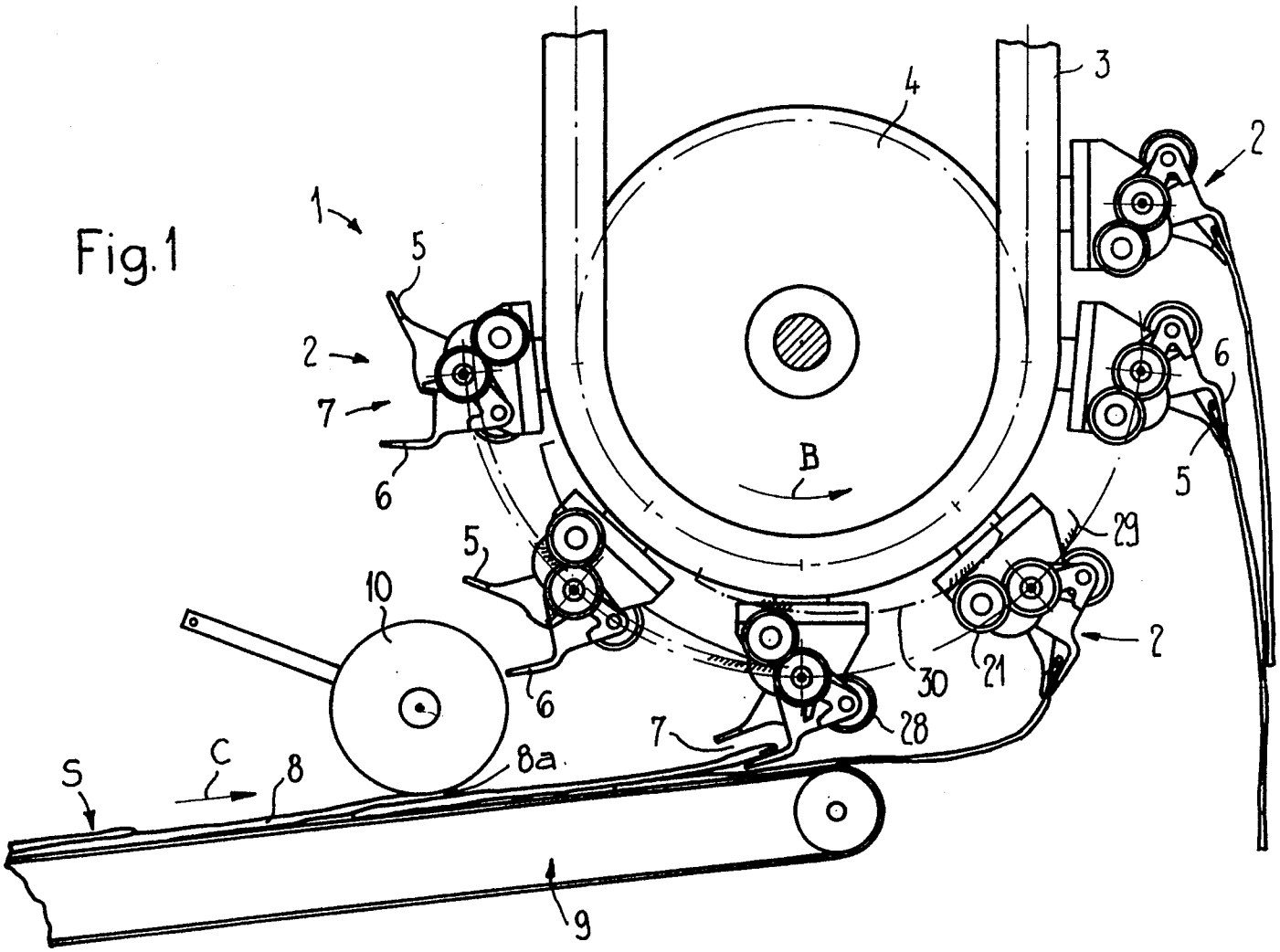
FIG. 1 shows a lateral view of a conveying device for carrying printed products away in the transfer region.

FIG. 1 shows the transfer region of a conveying device 1 which has grippers 2. The grippers 2 are fastened at regular intervals to a continuous link chain (not shown) guided in a chain duct 3. The link chain is guided over a deflection wheel 4 in the transfer region. The grippers 2 move in the direction of the arrow B along a closed circulation path.

Each gripper 2, whose construction and mode of functioning will be described in detail with reference to FIGS. 2–6, has a first gripper part 5 and a second gripper part 6. In the opened state of the grippers 2, the two gripper parts 5, 6 define a gripper opening 7 which faces towards the rear relative to the conveying direction B in the conveying device according to FIG. 1.

Each gripper 2 grips a printed product 8 at its leading edge 8*a* (fold edge). The printed products 8 are fed in the direction of the arrow C by a belt conveyor 9 in a manner known in the art in an imbricated formation S. As can be seen in FIG. 1, each printed product lies in this imbricated formation S on the preceding printed product 8. A pressure roller 10 lies loosely on the printed products 8 fed by the belt conveyor 9.

The construction of the grippers 2 is now explained in detail below with reference to FIGS. 2–4.

Figure 5:
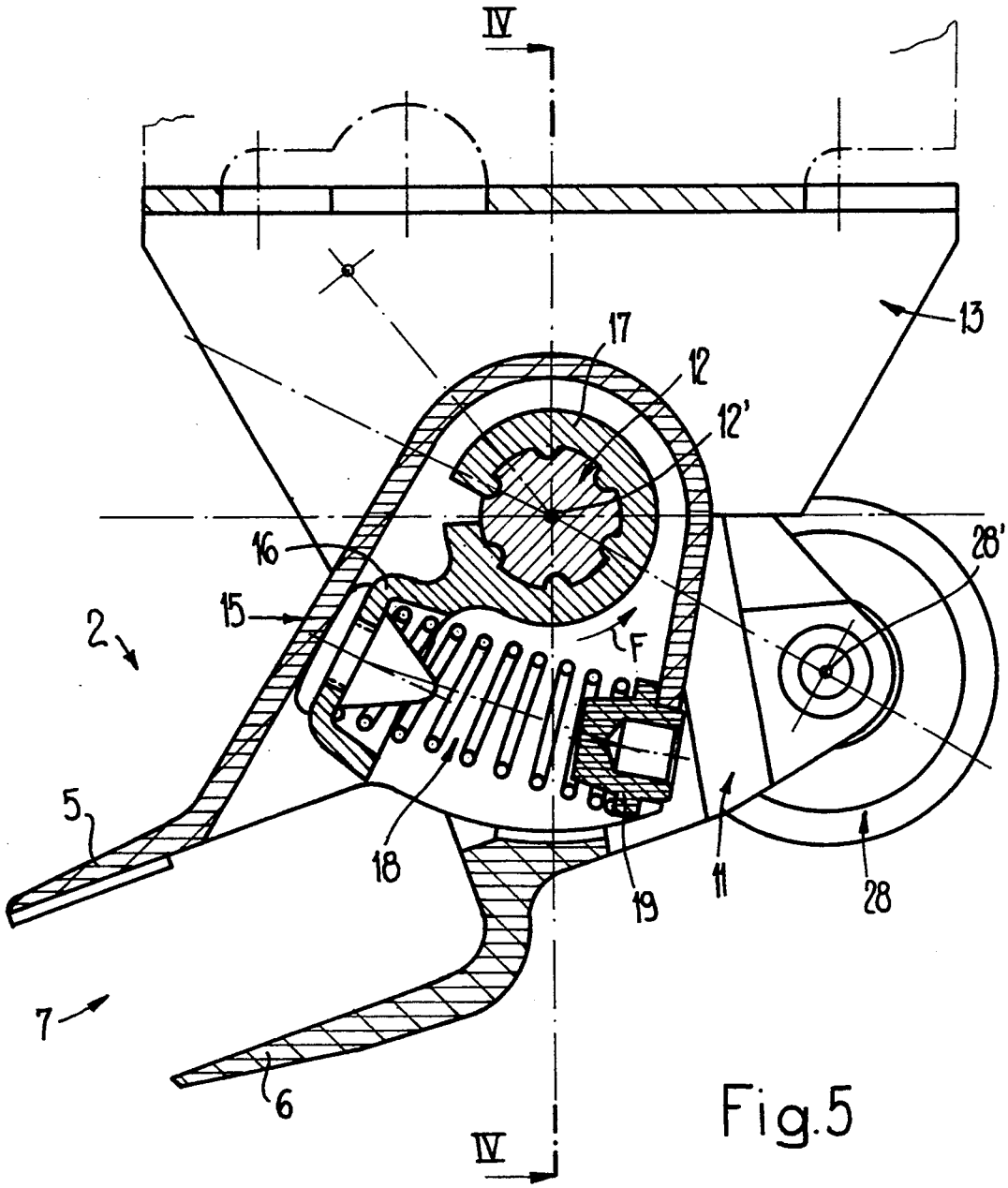
FIG. 5 shows a section along the line V—V in FIG. 4.
Figure 6:
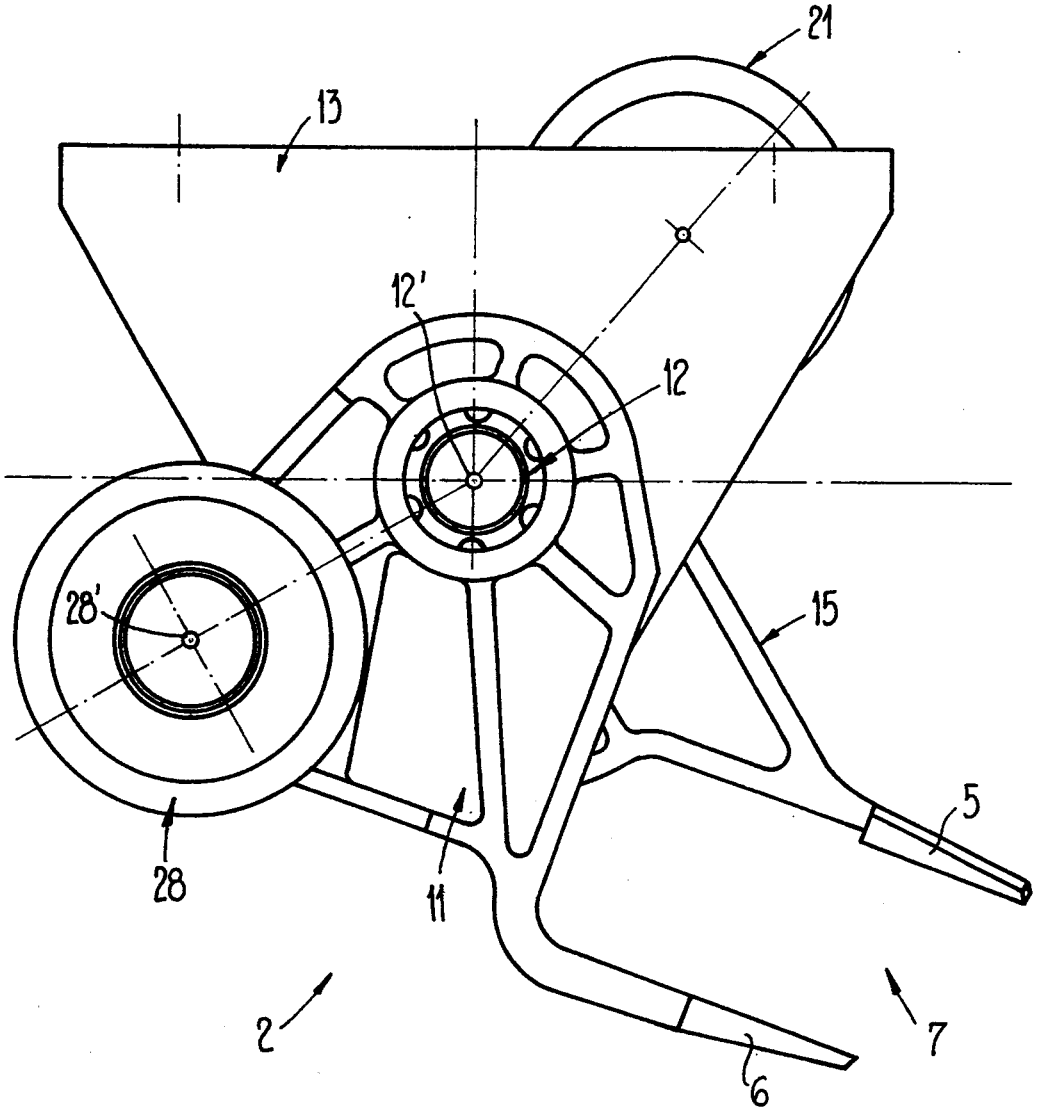
FIG. 6 shows a lateral view of the gripper in the direction of the arrow A in FIG. 4.

The second gripper part 6 is preferrably of integral construction with a bearing part 11 which is mounted so as to be pivotable on a shaft 12 whose longitudinal axis is denoted by 12'. As best illustrated in FIGS. 5 and 6, this shaft 12 is provided with longitudinal grooves. The shaft 12 is mounted rotatably in a holder 13 which is U-shaped in cross-section. The holder 13 is fastened to a link chain 14 which is guided in the guide duct already mentioned. This link chain 14 is of known design and is very similar to the link chain such as is described, for example, U.S. Pat. No. 4,294,345 or the corresponding DE-A-2,629,528 which are incorporated herein by reference. FIG. 4 shows in each case half of a link chain 14 of a lighter construction and of a link chain 14' of heavier construction.

The first gripper part 5 is likewise preferrably of integral construction with a bearing part 15 which is arranged inside the holder 13 and is mounted so as to be pivotable on the shaft 12. The longitudinal axis 12' of this shaft 12 thus forms the common pivot axis for the bearing parts 11, 15 and thus for the gripper parts 6 and 5. A resting part 16 is connected to the shaft 12 so as to be fixed against rotation. Specifically; the connection is via a spreader ring 17 which is integral with the resting part 16 and engages with projections in the longitudinal grooves of the shaft 12 (FIG. 5). A compression spring 18 is supported on the resting part 16. The compression spring 18 is supported at the other end on a journal 19 which is inserted in the bearing part 15 for the first gripper part 5. As can readily be seen in FIG. 5, rotary movement of the shaft 12 in a counterclockwise rotary direction, i.e., in the direction of the arrow F, is transmitted via the compression spring 18 to the bearing part 15 and thus the first gripper part 5. This results in pivoting the first gripper part 5 from the open position shown in FIGS. 2 and 5 to the clamping position illustrated in FIG. 3.

Connected to the shaft 12 so as to be fixed against rotation is a closing lever 20 whose pivot axis 20' coincides with the longitudinal axis 12' of the shaft 12. At its free end, the closing lever 20 bears a follower roller 21 which rotates freely about the axis of rotation 21'. The closing lever 20 is provided with a projecting blocking arm 22. The closing lever 20 is now arranged in such a way that the connecting line (denoted by 23 between the pivot axis 20' and the axis of rotation 21' of the follower roller 21) runs transversely to the direction of movement B or B' of the grippers 2 (FIG. 2). Furthermore, together with the plane D which is formed by the flat first gripper part 5, this connecting line 23 forms an angle $\alpha$ which is less than 90° (FIG. 2). This is important in order for the first gripper part 5 to be able to move from the open position into the clamping position during a movement in both directions of movement B and B'.

A locking device is provided for blocking the first gripper part 5 in its clamping position. The locking device has a locking lever 24 which is mounted on the bearing part 11 so as to be pivotable about the axis 24'. This locking lever 24 has at one end a blocking projection 25 which interacts with the blocking arm 22 on the closing lever 20 to lock the first gripper part 5, as is shown in FIG. 3. The locking lever 24 is pivoted by means of a spring 26 into its blocking position and held therein. At the other end, the locking lever 24 has a follower roller 27 which is mounted so as to be freely rotatable about the axis of rotation 27'. In the blocking position of the locking lever 24, the axis of rotation 27' of this follower roller 27 is flush with the longitudinal axis 12' of the shaft 12. This arrangement ensures that release of the locking lever 24, i.e., pivoting into its release position by an unlocking force P acting on the follower roller 27 (FIG. 3), is ensured in all pivot positions of the gripper 2.

Arranged on the bearing part 11 for the second gripper part 6 on the side opposite the locking lever 24 is a positioning follower roller 28 which is mounted so as to be freely rotatable about the axis 28'. In this arrangement, the axis of rotation 28' is flush with the pivot axis 24' of the locking lever 24. The positioning follower roller 28 interacts with positioning links or cams 29. By means of this interaction the pivot position of the second gripper part 6 and thus of the open and closed gripper 2 is defined. This second gripper part 6 is pivotable between two end positions which enclose with one another an angle of about 90°. One end position of the second gripper part 6 is illustrated in FIGS. 2 and 3, in which this second gripper part 6 runs approximately in the direction of movement B, B' of the grippers 2. In the other end position shown in FIGS. 7 and 8, the second gripper part 6 extends approximately perpendicular to the direction of movement B, B' of the grippers 2. By means of these end positions of the second gripper part 6, the end positions of the open and closed gripper are also defined. The gripper can assume any intermediate position depending on the design of the positioning links 29. It should also be mentioned in this context that the second gripper part 6 defining a plane E (FIG. 2) is offset relative to the common pivot axis 12' of the two gripper parts 5, 6. In other words the plane E is spaced from this common pivot axis 12', as can readily be seen in FIG. 2.

Fixed closing links or cams 30 are provided for closing the grippers 2. The fixed closing links or cams 30 act on the follower roller 21 of the closing lever 20 and bring about pivoting of the latter in the closing direction, i.e., counterclockwise in the illustration according to FIG. 2. These closing links 30 can be constructed in a manner known in the art to correspond to the particular requirements. These closing links 30 are illustrated only diagrammatically in the figures.

Figure 2:
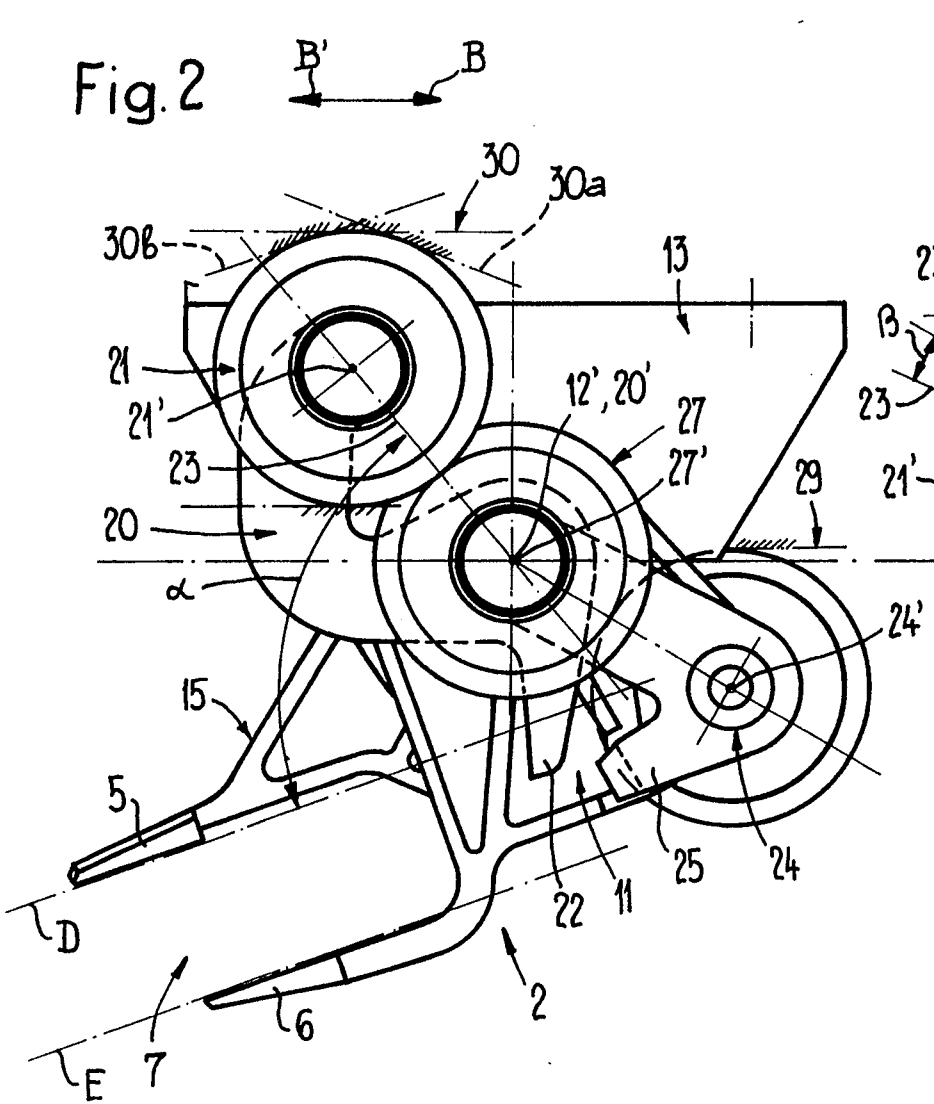

With reference to the closing links indicated by **30*a* and 30*b* in FIG. 2, it should be noted that the gripper 2 can be closed in both conveying directions B and B' by virtue of the arrangement and construction of the closing lever 20 described above. If the gripper is moved in the direction of the arrow B, the closing link 30*a* is to be provided. If, in contrast, the gripper 2 is moved in the opposite direction B', the closing link is to be constructed as indicated by 30*b***.

The mode of functioning of the gripper 2 is now explained below with reference to FIGS. 2 and 3.

Prior to closing the gripper 2, the second gripper part 6, is moved by the positioning link 29 into the desired product-receiving position and held therein (FIG. 2). To pivot the first gripper part from the open position into the clamping position, the closing link 30 (**30*a* or 30*b* respectively) begins to act on the follower roller 21 on the closing lever 20 which is thus pivoted counterclockwise. This results in a corresponding rotation of the shaft 12 and thus also for the resting part 16. This rotary movement of the resting part 16 is transmitted via the compression spring 18 to the bearing part 15 of the first gripper part 5, as a result of which the latter is pivoted towards the clamping position. When the closing lever 20 has now reached a position denoted by the connecting line 23*a* in FIG. 3, the first gripper part 5 comes into contact with the second gripper part 6. In this position, the compression spring 18 already exerts a certain clamping force. In this position of the closing lever 20, the blocking arm 22 also already begins to run up against the blocking projection 25 of the locking lever 24. When the closing lever 20 is rotated further, the locking lever 24 is now pressed back out of the blocking position by the blocking arm 22, continuing to act on the blocking position by the blocking arm 22, continuing to act on the blocking projection 25, counter to the force of the spring 26, i.e., is pivoted counterclockwise. When the closing lever 20 has reached its end position denoted by the connecting line 23 in FIG. 3, locking of the closing lever 20 is effected by the blocking projection 25 of the locking lever 24 acting on the blocking arm 22. This means that, for locking the first gripper part 5 in its clamping position, the closing lever 20 has to travel only a short path which is illustrated in FIG. 3 by the pivot angle $\beta$. During the pivoting of the closing lever 20 through the angle $\beta$, the compression spring 18 is compressed, which obviously results in the clamping force exerted by the first gripper part 5 being increased accordingly. The magnitude of this clamping force also depends on the thickness of the printed product 8 clamped between the gripper parts 5, 6**.

The short pivot path (angle $\beta$) which the closing lever 20 has to travel until it is locked, is possible because the compression spring 18 already exerts a clamping force, as already mentioned, as soon as the first gripper part 5 comes into contact with the second gripper part 6 or with the printed product 8 to be gripped which has run into the gripper opening 7.

Figure 3:
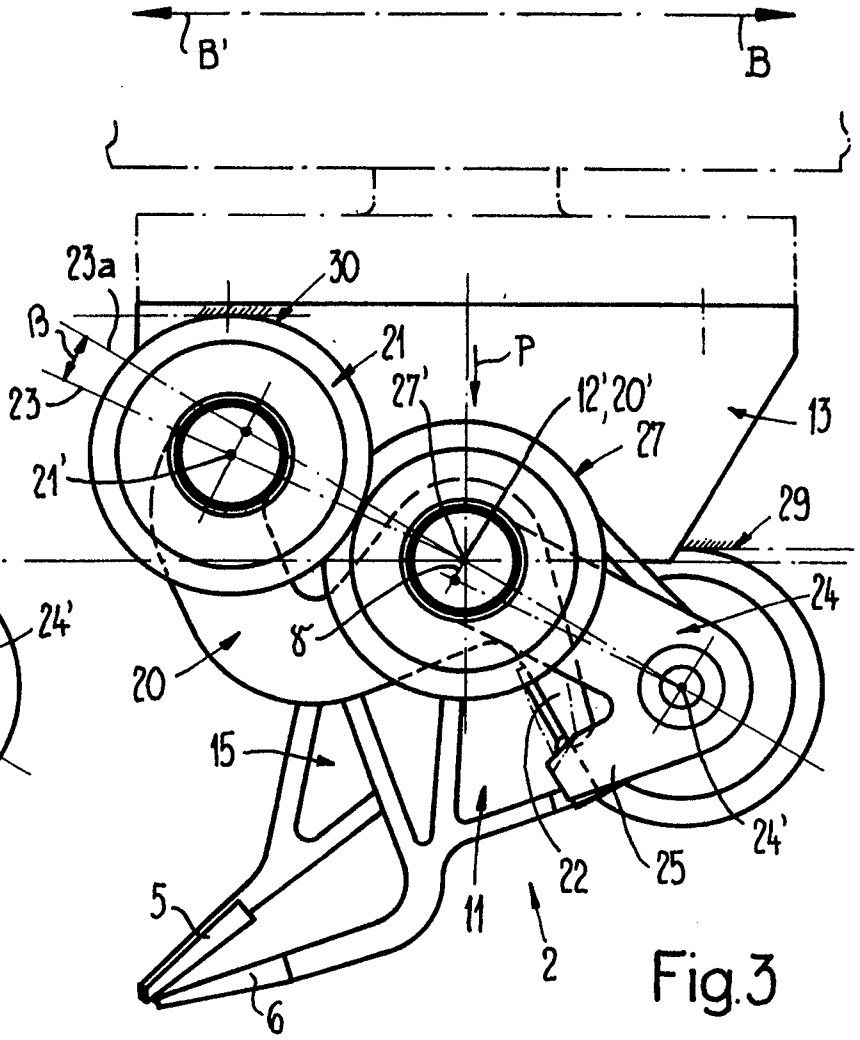
FIGS. 2 and 3 show a gripper of the conveying device according to FIG. 1 in the open and closed states respectively.

To unlock the closing lever 20 and thus the first gripper part 5, i.e., to open the gripper 2, an unlocking force P is exerted on the follower roller 27 mounted on the locking lever 24 by an opening arrangement which is not shown in FIG. 3. This results in the locking lever 24 being pivoted counterclockwise. After a short pivot path (small pivot angle $\beta$ in FIG. 3), the blocking projection 25 is released from the blocking arm 22 on the closing lever 20 which is pivoted clockwise under the effect of the compression spring 18 becoming relaxed. As soon as the blocking arm 22 is outside the range of action of the blocking projection 25 and the unlocking force no longer acts on the follower roller 27, the locking lever 24 is again pivoted back into its blocking position by the spring 26.

Figure 7:
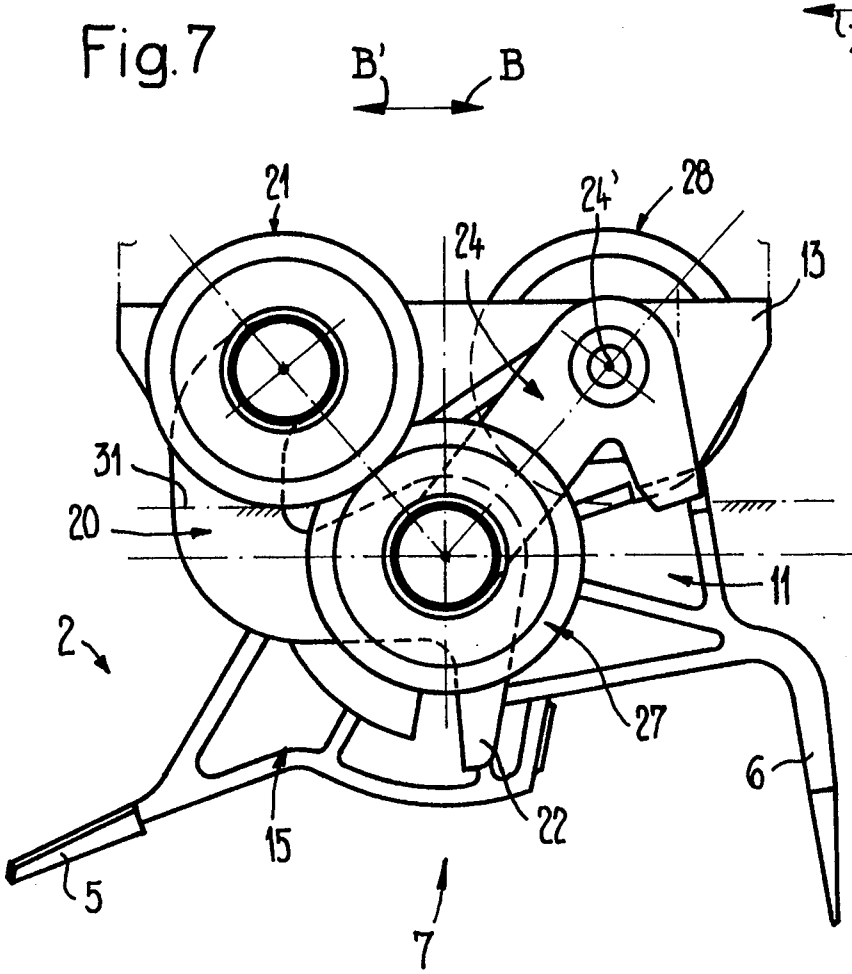

In illustrations corresponding to FIGS. 2 and 3, FIGS. 7 and 8 show a gripper 2 on the other end approximately perpendicular to the direction of movement B, B' of the gripper 2. The gripper 2 is moved into this end position by a positioning link 29 such as that described with respect to FIGS. 2 and 3 but which differs in construction from the positioning link 29 in FIGS. 2 and 3. FIG. 7 shows the first gripper part 5 in its extreme position. The gripper part 5 is held in the extreme position by a holding-open link or cam 31 which interacts with the follower roller 21 on the closing lever 20.

The closing, locking and opening of the gripper 2 are effected in the end position illustrated in FIGS. 7 and 8 in the same manner as described with reference to FIGS. 2 and 3, however, the different links-must be constructed accordingly, as mentioned.

Figure 8:
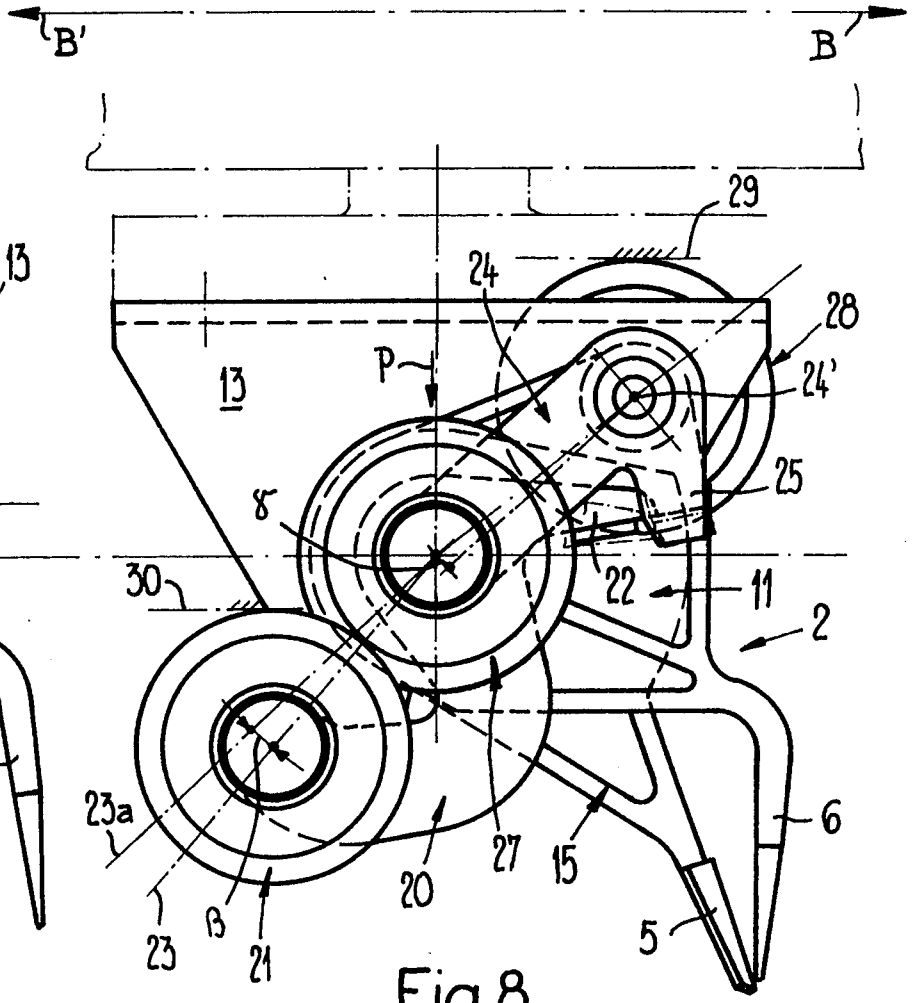
FIGS. 7 and 8 show a gripper in an illustration corresponding to FIGS. 2 and 3 in a different pivot position in the open and closed states respectively.

It can be seen by comparing FIGS. 2 and 3 with FIGS. 7 and 8 that the grippers 2 can be opened and closed in both end positions and thus also in any intermediate position, specifically irrespective of whether they are moved in the direction of the arrow B or in the direction of the arrow B'.

With reference to FIGS. 9–12, different possibilities of use of the grippers 2 are now described, as have been explained in conjunction with FIGS. 1–8.

Figure 9:
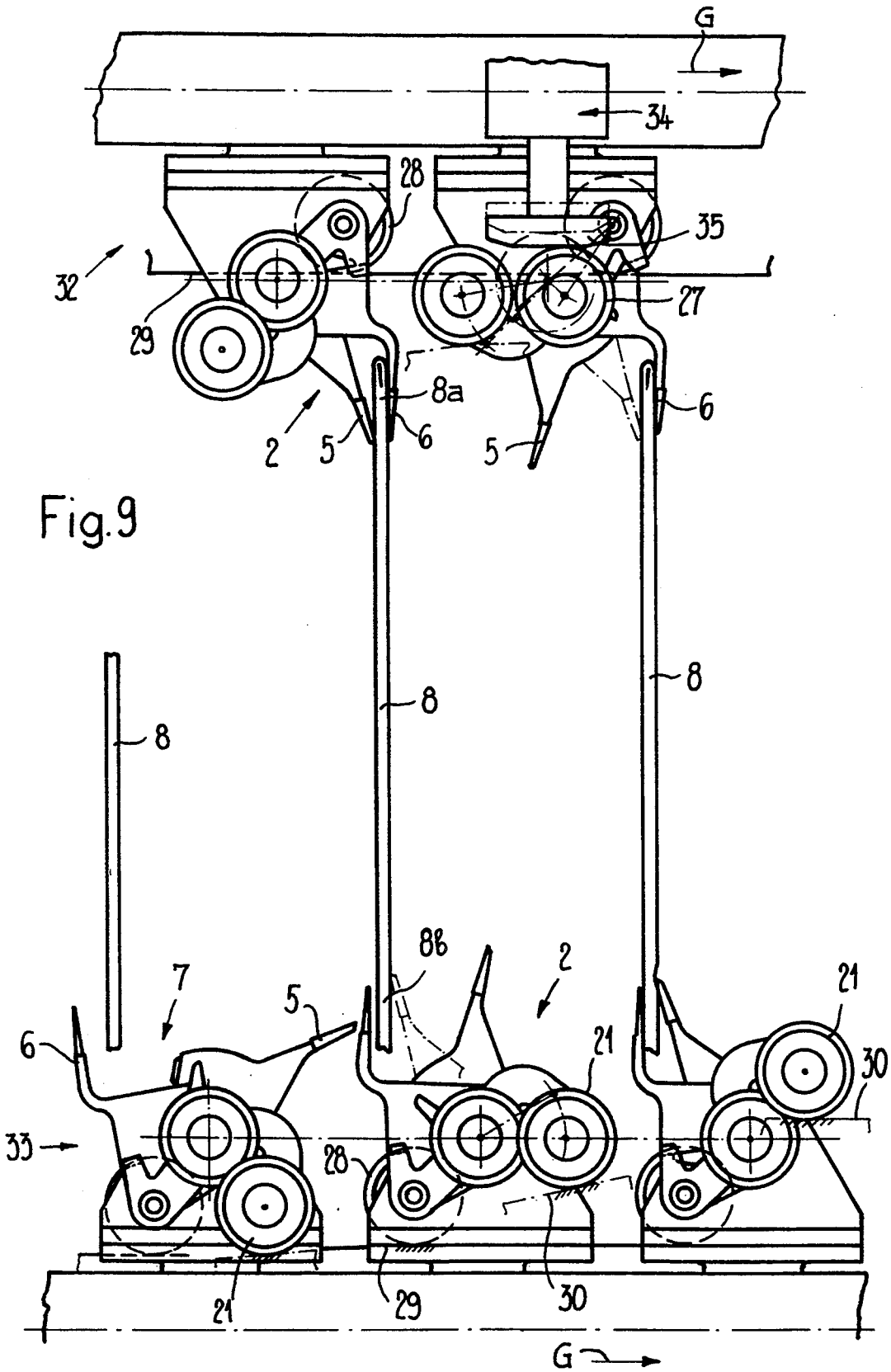
FIGS. 9–12 show different conveying devices with a different arrangement of the grippers.

In the embodiment according to FIG. 9, the printed products 8 are brought in a suspended position by a feed conveyor 32 and are taken over and conveyed further by a delivery conveyor 33. As described with reference to FIGS. 7 and 8, the grippers 2 of the feed conveyor 32 are held by positioning links 29 in an end position in which the second gripper part 6 runs approximately perpendicular to the conveying direction G of the feed conveyor 32. The grippers 2 of the delivery conveyor 3, which are moved in the same direction G, are likewise held in this end position, but the gripper opening 7 is directed upwards and the second gripper part 6 forms the trailing part of the grippers 2.

The printed products 8 held in the region of their one edge 8*a* by the grippers 2 of the feed conveyor 32 are gripped at the opposite edge b by the grippers 2 of the delivery conveyor 3. As soon as the printed products 8 are clamped in the grippers 2 of the delivery conveyor 3, the grippers 2 of the feed conveyor 32 are opened by means of an opening arrangement 34 which has an opening link or cam 35 which acts on the follower roller 27 on the locking lever 24.

Figure 10:
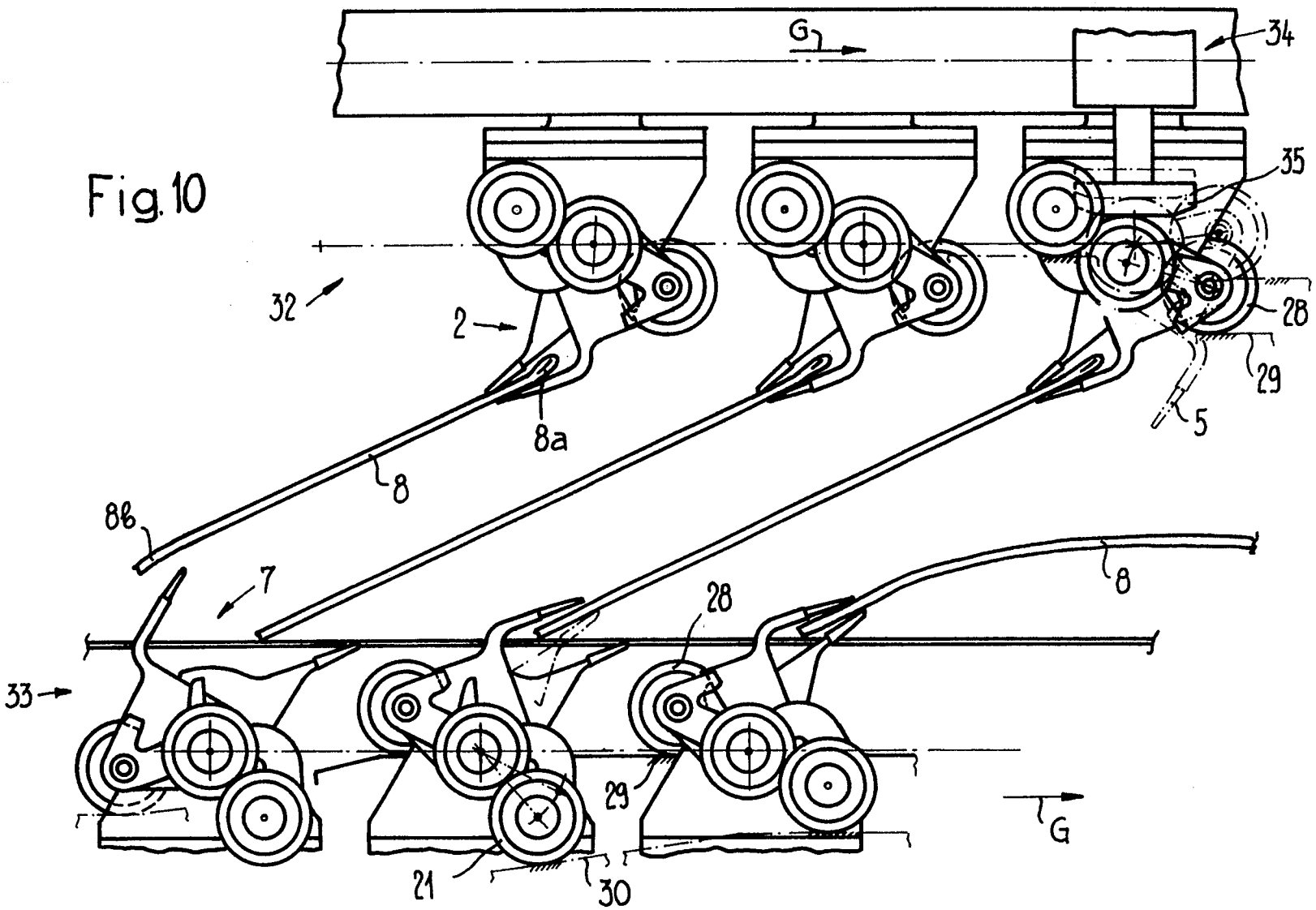

The embodiment according to FIG. 10 is very similar to that of FIG. 9 but differs from the latter by a different position of the grippers 2 during transfer of the printed products 8. In the embodiment according to FIG. 10, the gripper openings 7 are not directed downwards or upwards, but obliquely towards the rear in the feed conveyor 32 and obliquely towards the front in the delivery conveyor 33.

Figure 11:
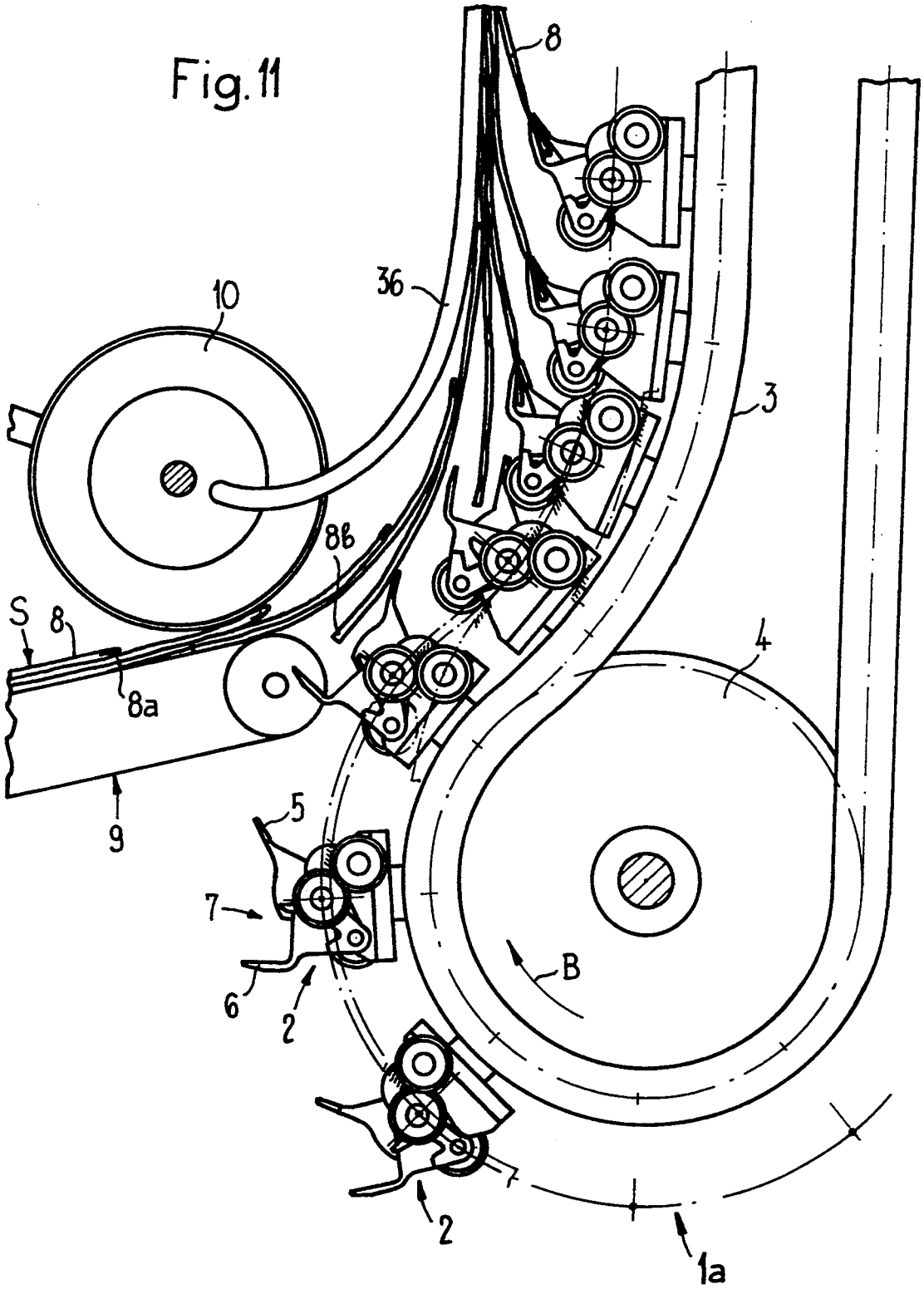

The embodiment shown in FIG. 11 is related to a certain extent to the embodiment according to FIG. 1. Howevers in contrast to the variant according to Figure is the printed products 8 fed by the belt conveyor 9 in an imbricated formation S are not gripped at the leading edge 8*a*, but at the trailing edge 8*b*. This requires a different position of the gripper 2 in the transfer region than in the embodiment shown in FIG. 1. In FIG. 11, reference numeral 36 shows a guide for the printed products 8.

Figure 12:
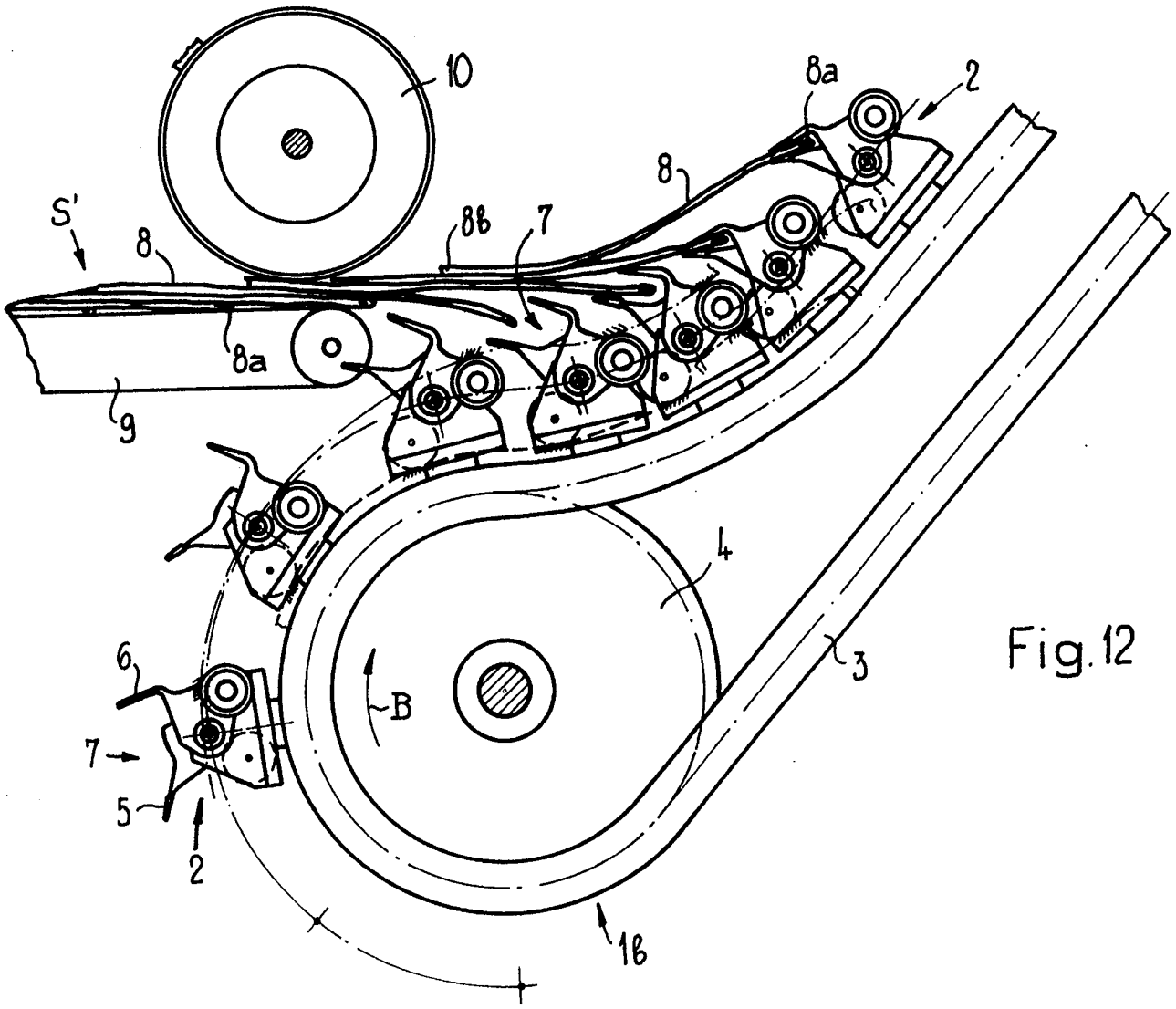

In the embodiment according to FIG. 12 which is similar to that according to FIG. 1, the belt conveyor 9 brings the printed products 8 in an imbricated formation S' in which each printed product 8 lies on the following printed product. This means that the leading edges 8*a* of the printed products 8 lie at the bottom in the imbricated formation S'.

The printed products 8 are gripped by the conveying device 1*b* at this leading edge 8*a*. This means that the gripper openings 7 must point towards the rear in the transfer region.

It can readily be seen in FIG. 1 and in FIGS. 9–12 that the same gripper construction as was described with reference to FIGS. 2–8 can be used for conveying devices 1, 1*a*, 1*b*, 32, 33 with different tasks. By virtue of their special construction, the grippers 2 can be moved into different pivot positions and can be closed and opened satisfactorily in any pivot position without requiring constructive adaptations of the grippers 2 to the respective purpose. It is understood that the positioning links 29, the opening links 35 and any holding-open links 31 must be adapted to the particular purpose of the conveying devices. The corresponding links are indicated diagrammatically in FIGS. 9–12.

A further advantage of the gripper construction described is that the grippers 2 can be made and assembled in a simple manner. The two gripper parts 5 and 6, together with their bearing parts 11 and 15 respectively can be made of plastic, which results in a light construction. Since the closing force is primarily applied by the compression spring 18, the first gripper part 5 only has to have a limited flexibility. In order to secure the shaft 12 against displacement in the direction of its longitudinal axis 12', the shaft 12 is provided in the region of the spreader ring 17 with a circumferential groove in which a rib on the inside of the spreader ring 17 engages in the manner of a snap-on connection in the assembled state. This easy-assembly solution obviates the need for mounting separate securing rings or the like.

It is also conceivable to connect the first gripper part 5 to the shaft 12 directly via a spring element which bears the first gripper part 5 at one end and is connected to the shaft 12 at the other end. This spring element then forms both the bearing part for the first gripper part 5 and the closing spring which is stressed when the gripper is closed. Such an arrangement is described, for example, U.S. Pat. No. 4,381,056 and the corresponding DE-A-3,102,242 which are incorporated herein by reference.

Figure 4:
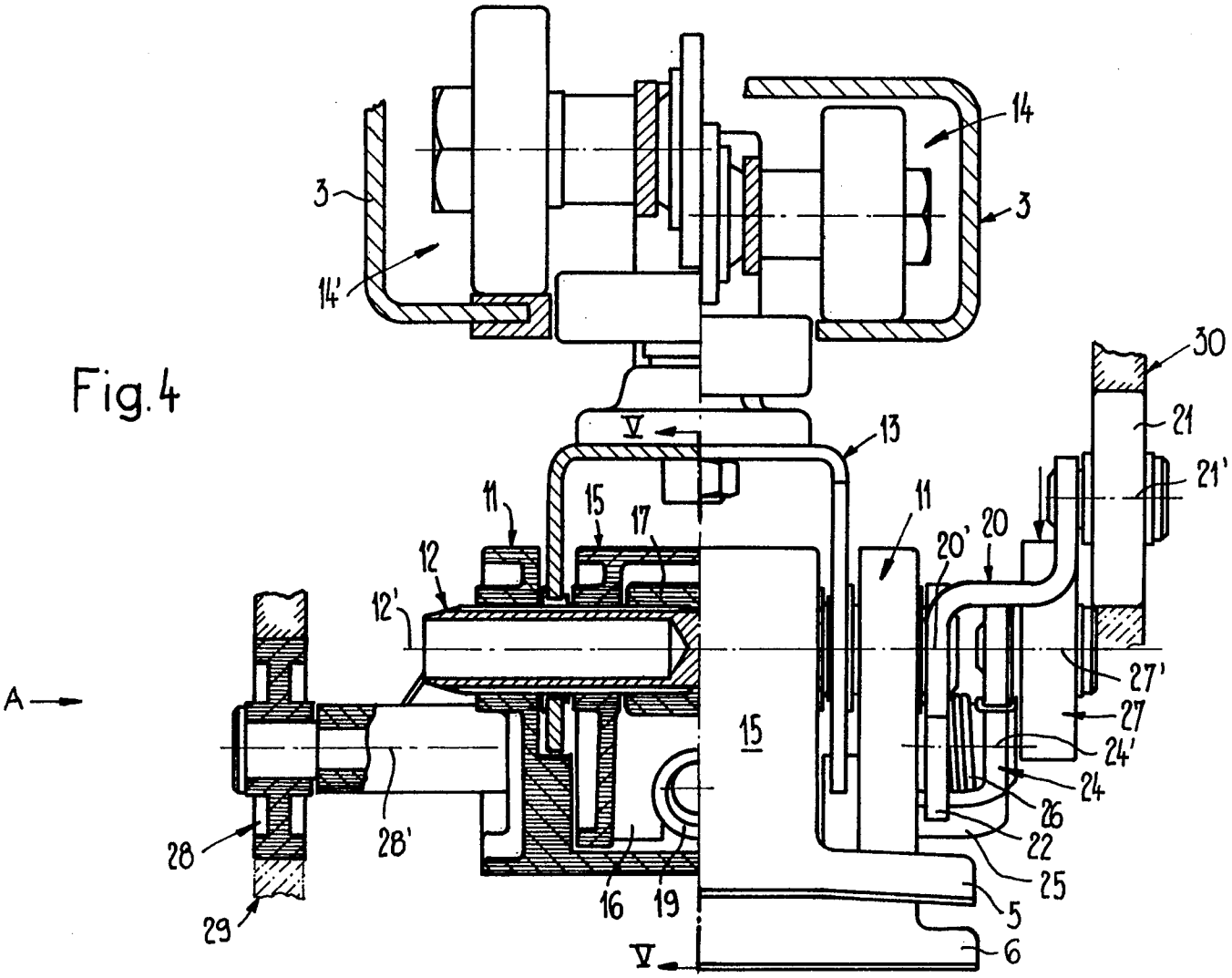
FIG. 4 shows a plan view of a gripper according to FIGS. 2 and 3, partially in section along the line IV—IV in FIG. 5.

Instead of fastening the grippers 2 at fixed intervals on a link chain 14, as shown with reference to FIG. 4, it is also possible to mount them on bearing elements which, though coupled to one another, can be varied, however, in their spacing. Such a solution with bearing elements which can be varied in their spacing is described, for example, U.S. Pat. No. 5,007,629 and the corresponding EP-A-0,323,557 which are incorporated herein by reference.

The present invention has been illustrated and described with respect to the preferred embodiments of the invention. It is to be understood that the invention is not limited thereto, but may be otherwise variously embodied and practiced within the scope of the following claims including all equivalents.

We claim:

1. A gripper for a conveying device for single-sheet or multiple-sheet printed products such as newspapers, magazines and parts thereof, comprising:

first and second gripper parts mounted for pivotal movement about a common axis, said first gripper part being pivotable between an open position and a clamping position in which it cooperates with said second gripper part to clamp a printed product under spring force;

a closing lever mounted for pivotal movement about a pivot axis and being coupled to said first gripper part, said closing lever having a follower member for coacting with a closing cam for pivoting the first gripper part into said clamping position, said closing lever and said closing lever follower member being configured such that said first gripper part can be moved into said clamping position by the closing cam acting on said follower member in substantially all pivot positions of said first and second gripper parts;

a holder in which a shaft is rotatably mounted;

said shaft defining the commonpivot axis of said first and second gripper parts, said closing lever being connected to said shaft and fixed against rotation relative to said shaft, said shaft being coupled to said first gripper part and said second gripper part being pivotably mounted on said shaft;

a locking device for blocking said first gripper part in its clamping position, said locking device comprising a locking lever which acts on said shaft for blocking said first gripper part in its clamping position, said locking lever being mounted for pivotal movement into a position wherein it is releasable by a stationary opening arrangement disposed along the path of travel of the gripper;

said locking lever having a follower member located on said locking lever, said locking lever follower member having a control surface for engaging the opening arrangement, said control surface being curved about an axis and said control surface axis arranged approximately coaxially with the pivot axis of said two gripper parts in the blocking position of said locking lever; and a positioning follower member coupled to said second gripper part for interacting with fixed positioning cams for holding said second gripper part in a particular pivot position.

2. The gripper according to claim 1 wherein said shaft is connected to said first gripper part by a spring element which is stressed when the gripper is closed.

3. The gripper according to claim 1 comprising a resting part fixedly connected against rotation to said shaft and a spring element supported on the resting part, said spring element being coupled to said first gripper part such that said spring element is stressed when the gripper is closed.

4. The gripper according to claim 1 wherein said closing lever follower member comprises a rotatably mounted follower roller.

5. The gripper according to claim 4 wherein said closing lever is arranged within the closing range of the gripper relative to the direction of movement of the gripper so that a line connecting the pivot axis of the closing lever and the axis of rotation of the closing lever follower member extends transversely of the direction of movement of the gripper.

6. The gripper according to claim 4 wherein said first gripper part comprises a substantially flat, first gripper part and a line connecting the pivot axis of the closing lever and the axis of rotation of the closing lever follower member encloses an angle $\alpha$ of less than 90° with the substantially flat, first gripper part.

7. The gripper according to claim 1 wherein said locking lever acts on said shaft through a blocking part which is fixed against rotation with said shaft.

8. The gripper according to claim 7 wherein said blocking part comprises an arm which is integral with said locking lever.

9. The gripper according to claim 7 wherein the axis of rotation of the positioning follower member runs approximately coaxially with the pivot axis of said locking lever.

10. The gripper according to claim 1 wherein said second gripper part is pivotable between a first end position in which the second gripper part extends in a direction running approximately perpendicular to the direction of movement of the grippers and a second end position in which the second gripper part extends in a direction running approximately in the direction of movement of the gripper.

11. The gripper according to claim 1 wherein said second gripper part lies in a plane spaced from its pivot axis.

12. The gripper according to claim 1 wherein said locking lever follower member is a roller rotatably mounted on said locking lever, the axis of rotation of said roller being approximately coaxial with the pivot axis of the two gripper parts in the blocking position of said locking lever.

13. A conveying device for conveying single-sheet or multiple-sheet printed products and having a plurality of grippers guided along a closed circulation path, each of the gripper comprising:

first and second gripper parts mounted for pivotal movement about a common axis, said first gripper part being pivotable between an open position and a clamping position in which it cooperates with said second gripper part for clamping a printed product under spring force;

a closing lever coupled to said first gripper part and including a follower member for coacting with a closing cam for pivoting said first gripper part into the clamping position, said closing lever and said closing lever follower member being configured such that said first gripper part can be moved into said clamping position by the closing cam acting on said follower member in substantially all pivot positions of said first and second gripper parts;

a locking device, said locking device comprising a locking lever for blocking said first gripper in its clamping position, said locking lever being mounted for pivotal movement into a position wherein it is releasable by a stationary opening arrangement disposed along the path of travel of the gripper;

said locking lever having a follower member located on said locking lever, the locking lever follower member having a control surface for engaging the opening arrangement, said control surface being curved about an axis and said control surface axis arranged approximately coaxially with the pivot axis of said two gripper parts in the blocking position of said locking lever; and a positioning follower member connected to said second gripper part for interacting with fixed positioning cams for holding said second gripper part in a particular pivot position.

14. The conveying device according to claim 13 wherein the grippers are fastened at predetermined intervals on a flexible pulling member which is guided in a guide.

15. The conveying device according to claim 14 wherein said pulling member comprises a link chain.

16. The conveying device according to claim 15 wherein the grippers are fastened to bearing elements which are arranged successively, are coupled to one another, and are variable in their spacing.

* * * * *